US010730101B2

(12) United States Patent
Maegawa et al.

(10) Patent No.: US 10,730,101 B2
(45) Date of Patent: Aug. 4, 2020

(54) METHOD OF PRODUCING FOAMED SAND AND PRODUCTION APPARATUS FOR PRODUCING FOAMED SAND

(71) Applicants: TOYOTA JIDOSHA KABUSHIKI KAISHA, Toyota-shi, Aichi-ken (JP); SINTOKOGIO, LTD., Nagoya, Aichi (JP)

(72) Inventors: Takumi Maegawa, Toyota (JP); Masashi Morikawa, Nagakute (JP); Kenichiro Mori, Toyokawa (JP); Yusuke Kato, Toyokawa (JP)

(73) Assignees: TOYOTA JIDOSHA KABUSHIKI KAISHA, Toyota-shi, Aichi-ken (JP); SINTOKOGIO, LTD., Nagoya, Aichi (JP)

( * ) Notice: Subject to any disclaimer, the term of this patent is extended or adjusted under 35 U.S.C. 154(b) by 281 days.

(21) Appl. No.: 15/770,918

(22) PCT Filed: Oct. 25, 2016

(86) PCT No.: PCT/IB2016/001530
§ 371 (c)(1),
(2) Date: Apr. 25, 2018

(87) PCT Pub. No.: WO2017/077372
PCT Pub. Date: May 11, 2017

(65) Prior Publication Data

US 2018/0326473 A1 Nov. 15, 2018

(30) Foreign Application Priority Data

Nov. 6, 2015 (JP) ..... 2015-218764

(51) Int. Cl.
*B22C 5/04* (2006.01)
*B22C 9/02* (2006.01)
(Continued)

(52) U.S. Cl.
CPC ..... *B22C 1/12* (2013.01); *B22C 1/02* (2013.01); *B22C 5/04* (2013.01); *B22C 5/0409* (2013.01);
(Continued)

(58) Field of Classification Search
CPC .... B22C 1/02; B22C 1/12; B22C 5/04; B22C 5/0409; B22C 5/0472; B22C 9/02; B22C 19/04
See application file for complete search history.

(56) References Cited

U.S. PATENT DOCUMENTS

2006/0071364 A1* 4/2006 Zenpo ..... B22C 1/22 264/219
2014/0284015 A1 9/2014 Mitsutake et al.
2016/0052047 A1* 2/2016 Uchida ..... B22C 5/0413 164/37

FOREIGN PATENT DOCUMENTS

JP 07047264 A 2/1995
JP 2013-111602 A 6/2013
(Continued)

*Primary Examiner* — Kevin E Yoon
(74) *Attorney, Agent, or Firm* — Sughrue Mion, PLLC

(57) ABSTRACT

Provided is a method of producing foamed sand (s) for forming a sand mold. The foamed sand (s) includes sand particles (p) and foam (f) adhering to surfaces of the sand particles (p). The foam (f) contains water glass (b), water (w), and a surfactant (c). According to the method, an aqueous surfactant solution (e) in which the surfactant (c) is dissolved is frothed to generate froth (d) from the aqueous surfactant solution (e). Then, the generated froth (d), the water glass (b), and the water (w) are kneaded with the sand constituted by the sand particles (p).

9 Claims, 9 Drawing Sheets

(51) Int. Cl.

| | |
|---|---|
| ***B22C 1/12*** | (2006.01) |
| ***B22C 1/02*** | (2006.01) |
| ***B22C 19/04*** | (2006.01) |
| *B22C 15/23* | (2006.01) |

(52) U.S. Cl.
CPC ..... *B22C 5/0472* (2013.01); *B22C 9/02* (2013.01); *B22C 19/04* (2013.01); *B22C 15/23* (2013.01)

(56) References Cited

FOREIGN PATENT DOCUMENTS

| | | | |
|---|---|---|---|
| JP | 2014-018851 | A | 2/2014 |
| JP | 2014064990 | A | 4/2014 |

* cited by examiner

METHOD OF PRODUCING FOAMED SAND AND PRODUCTION APPARATUS FOR PRODUCING FOAMED SAND

CROSS REFERENCE TO RELATED APPLICATIONS

This application is a National Stage of International Application No. PCT/IB2016/001530, filed on Oct. 25, 2016, which claims priority from Japanese Patent Application No. 2015-218764, filed on Nov. 6, 2015.

BACKGROUND OF THE INVENTION

1. Field of the Invention

The invention relates to a method of producing foamed sand for forming a sand mold, and relates also to a production apparatus for producing foamed sand.

2. Description of Related Art

When a cylinder block, a cylinder head, or the like of an engine is cast, a sand mold (core) that can be broken is used to form a hollow section, such as a water jacket, an intake port, an exhaust port, or the like. The sand mold is formed of foamed sand in some cases.

In such foamed sand, foam containing water glass (liquid glass), water, and a surfactant adheres (is adsorbed) to the surfaces of sand particles, and the water glass serves as a binder that binds the sand particles together. An example of a method of producing the foamed sand is described in Japanese Unexamined Patent Application Publication No. 2013-111602 (JP 2013-111602 A).

In the production method, water glass, water, and a surfactant are added to sand (a cluster of sand particles) constituted by sand particles serving as an aggregate, and then they are kneaded. In this way, a composition containing the water glass, the water, and the surfactant is foamed, and the foam adheres to the surfaces of the sand particles.

SUMMARY OF THE INVENTION

However, in the method of producing foamed sand according to JP 2013-111602 A, foaming by the surfactant is performed when the sand, the water glass, and so forth are kneaded. For this reason, even when the sand, the water glass, and so forth are uniformly kneaded, foaming by the surfactant may be insufficient. In view of this, even if the sand, the water glass, and so forth are uniformly kneaded, they need to be further kneaded until the foamed sand is brought into a desired foamed state (i.e., until desired foam is formed on the surfaces of the sand particles). As a result, the kneading time needs to be prolonged.

The invention provides a method of producing foamed sand for forming a sand mold and a production apparatus for producing foamed sand, the method and the production apparatus allowing reduction in the kneading time required to produce the foamed sand.

A first aspect of the invention relates to a method of producing foamed sand for forming a sand mold. The foamed sand includes sand particles and foam adhering to surfaces of the sand particles. The foam contains water glass, water, and a surfactant. The method according to the first aspect includes: generating froth from an aqueous surfactant solution in which the surfactant is dissolved, by frothing the aqueous surfactant solution; and kneading the generated froth, the water glass, and the water together with the sand constituted by the sand particles.

According to the first aspect of the invention, first, the aqueous surfactant solution is frothed to generate the froth from the aqueous surfactant solution. The generated froth, the water glass, and the water are kneaded together with the sand. When they are kneaded uniformly, it is possible to shorten the time (foaming time) of foaming by the surfactant through further kneading. Note that, "sand" means a cluster of "sand particles".

In the first aspect, when the froth is generated, the aqueous surfactant solution may be frothed by causing the aqueous surfactant solution to pass through a plurality of pores together with air.

According to the above aspect, the froth can be generated more finely and uniformly from the aqueous surfactant solution within a shorter time, because the aqueous surfactant solution is frothed by causing the aqueous surfactant solution to pass through the plurality of pores together with the air.

A second aspect of the invention relates to a production apparatus for producing foamed sand for forming a sand mold. The foamed sand includes sand particles and foam adhering to surfaces of the sand particles. The foam contains water glass, water, and a surfactant. The production apparatus includes: a storage portion in which sand constituted by the sand particles is stored; a water glass supply portion configured to supply the water glass into the storage portion; a water supply portion configured to supply the water into the storage portion; a froth supply portion configured to supply, into the storage portion, froth generated by frothing an aqueous surfactant solution in which the surfactant is dissolved; and a kneader configured to knead, in the storage portion, the sand with the water glass, the water, and the froth supplied into the storage portion.

According to the second aspect of the invention, before kneading is performed in the kneader, the aqueous surfactant solution is frothed in the froth supply portion to generate the froth from the aqueous surfactant solution, and the froth is supplied into the storage portion instead of supplying the aqueous surfactant solution in a liquid state into the storage portion. Then, the froth, the water glass, and the water are supplied into the storage portion in which the sand (powder) constituted by the sand particles is stored, and then the froth, the water glass, and the water are kneaded, by the kneader, together with the sand.

According to the second aspect of the invention, the froth generated before kneading, the water glass, and the water are kneaded together with the sand. Thus, when they are uniformly kneaded, it is possible to shorten the time of foaming by the surfactant through further kneading. As a result, the foamed sand can be produced within a shorter time.

In the second aspect, the froth supply portion may include: a liquid supply pipe configured to supply the aqueous surfactant solution; an air supply pipe configured to supply air; a joining portion in which the aqueous surfactant solution supplied from the liquid supply pipe and the air supplied from the air supply pipe join together; and a porous body having a plurality of pores. The porous body is configured to allow the aqueous surfactant solution and the air that have joined in the joining portion to pass through therethrough to froth the aqueous surfactant solution.

According to the above aspect, the aqueous surfactant solution supplied from the liquid supply pipe and the air supplied from the air supply pipe join together in the joining portion, and then the aqueous surfactant solution passes through the plurality of pores of the porous body together with the air, so that the aqueous surfactant solution is frothed. As a result, the froth can be finely and uniformly generated from the aqueous surfactant solution in the froth supply portion within a short time.

In the above aspect, the production apparatus may further include a controller configured to control start and stop of supply of the aqueous surfactant solution from the liquid supply pipe, and control start and stop of supply of the air from the air supply pipe. The controller may be configured to: i) start the supply of the air from the air supply pipe when the supply of the aqueous surfactant solution from the liquid supply pipe is started; ii) then temporarily stop the supply of the air from the air supply pipe when the supply of the aqueous surfactant solution from the liquid supply pipe is stopped; and iii) then restart the supply of the air from the air supply pipe such that air having a pressure higher than a pressure of the air supplied before temporary stop of the supply is supplied for a prescribed time.

According to the above aspect, after the froth is supplied into the storage portion, the high pressure air is supplied from the air supply pipe into the joining portion for the prescribed time, and thus the aqueous surfactant solution remaining in, for example, the porous body can be discharged. As a result, dripping of the aqueous surfactant solution from the porous body can be prevented or reduced.

In the above aspect, the production apparatus may further include a controller configured to control start and stop of supply of the aqueous surfactant solution from the liquid supply pipe, and control start and stop of supply of the air from the air supply pipe. The controller may be configured to: i) start the supply of the air from the air supply pipe when the supply of the aqueous surfactant solution from the liquid supply pipe is started; ii) then stop the supply of the aqueous surfactant solution from the liquid supply pipe; and iii) stop the supply of the air from the air supply pipe after a lapse of a prescribed time from the stop of the supply of the aqueous surfactant solution.

According to the above aspect, even after the froth is supplied into the storage portion, the air is continuously supplied from the air supply pipe into the joining portion for the prescribed time. In this case as well, the aqueous surfactant solution remaining in, for example, the porous body can be discharged. As a result, dripping of the aqueous surfactant solution from the porous body can be prevented or reduced.

In the above aspect, the production apparatus may further include: a vacuum mechanism connected to the joining portion, the vacuum mechanism configured to operate to generate a negative pressure in an inside of the joining portion; and a controller configured to control start and stop of supply of the aqueous surfactant solution from the liquid supply pipe, control start and stop of supply of the air from the air supply pipe, and control an operation of the vacuum mechanism and stop of the operation. The controller may be configured to: i) start the supply of the air from the air supply pipe when the supply of the aqueous surfactant solution from the liquid supply pipe is started; ii) then stop the supply of the air from the air supply pipe when the supply of the aqueous surfactant solution from the liquid supply pipe is stopped; and iii) then operate the vacuum mechanism for a prescribed time from the stop of the supply of the air and the aqueous surfactant solution.

According to the above aspect, after the froth is supplied into the storage portion, a negative pressure is generated in the inside of the joining portion for the prescribed time by the vacuum mechanism, and thus the aqueous surfactant solution remaining in, for example, the porous body can be suctioned out of the joining portion. As a result, dripping of the aqueous surfactant solution from the porous body can be prevented or reduced.

In the above aspect, the production apparatus may further include: an on-off valve disposed below the porous body, the on-off valve configured to allow supply of the froth from the porous body into the storage portion while the on-off valve is open, and stop the supply of the froth from the porous body into the storage portion while the on-off valve is closed; and a controller configured to control start and stop of supply of the aqueous surfactant solution from the liquid supply pipe, control start and stop of supply of the air from the air supply pipe, and control opening and closing of the on-off valve. The controller may be configured to: i) open the on-off valve and start the supply of the air from the air supply pipe when the supply of the aqueous surfactant solution from the liquid supply pipe is started; ii) then stop the supply of the air from the air supply pipe when the supply of the aqueous surfactant solution from the liquid supply pipe is stopped; and iii) then close the on-off valve after a lapse of a prescribed time from the stop of the supply of the air and the aqueous surfactant solution.

According to the above aspect, after the froth is supplied into the storage portion, outflow of the aqueous surfactant solution remaining in, for example, the porous body can be restricted by the on-off valve after a lapse of the prescribed time. As a result, dripping of the aqueous surfactant solution remaining in, for example, from the porous body into the storage portion can be prevented or reduced.

A pressure sensor that measures a pressure of the air in an air flow path of the air supply pipe may be provided. According to this aspect, an insufficient supply of the air from the air supply pipe can be found, and the occurrence of insufficient generation of the froth can be reduced in advance.

According to the invention, the kneading time required to produce the foamed sand can be reduced.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
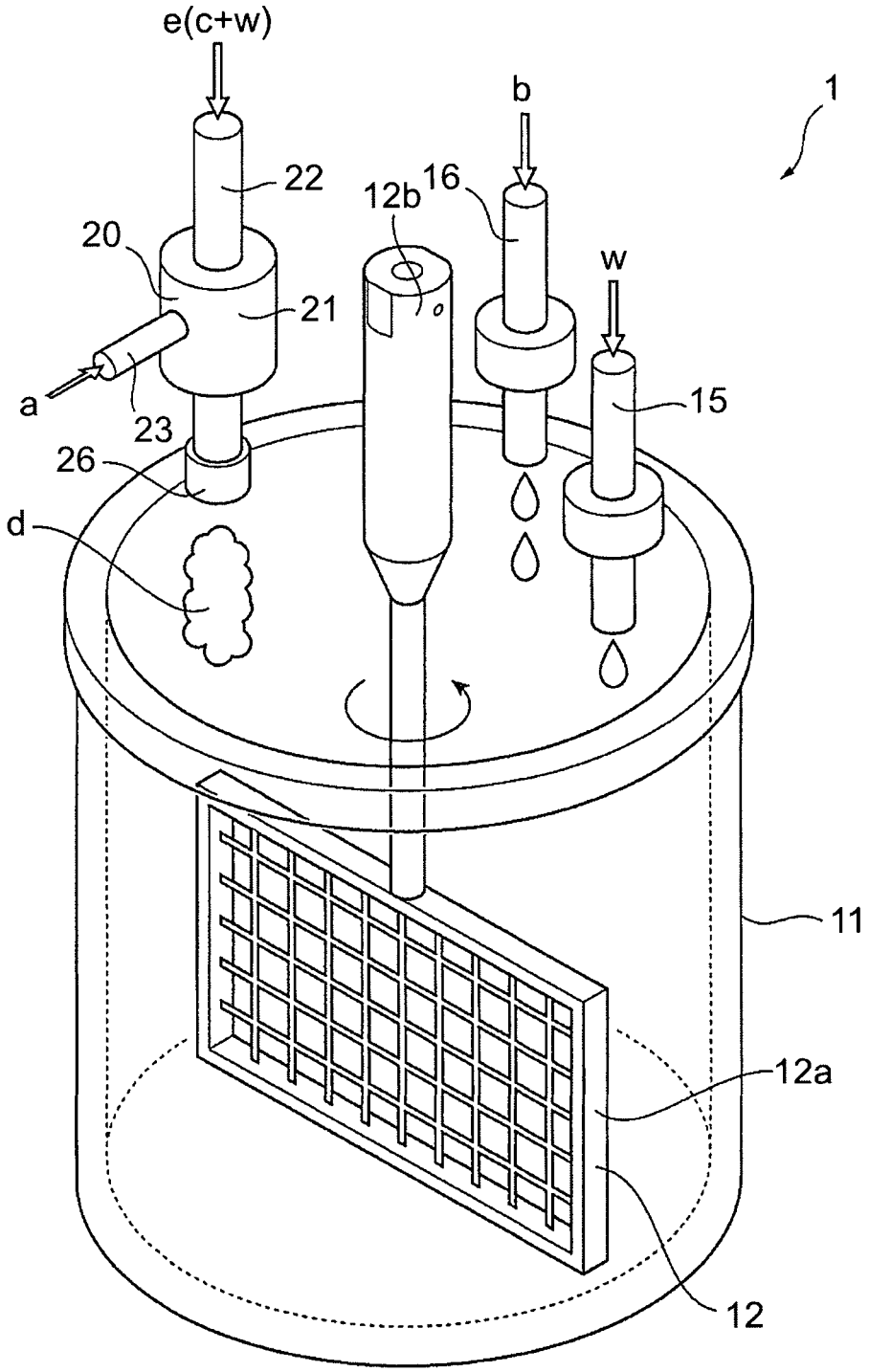
FIG. 1 is a schematic perspective view of a production apparatus for producing foamed sand according to an embodiment of the invention.
Figure 2:
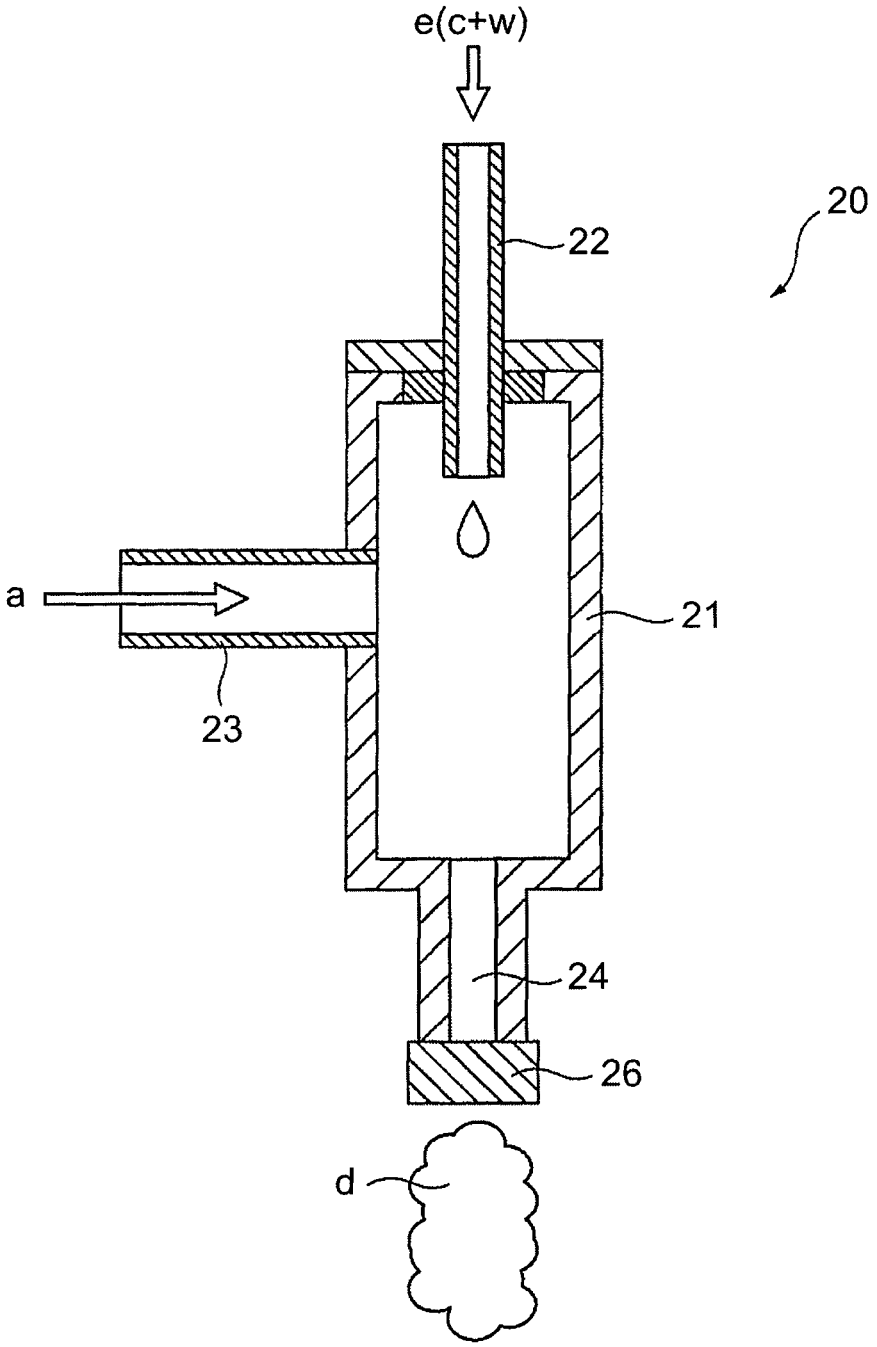
FIG. 2 is a sectional view of a froth supply portion of the production apparatus for producing foamed sand illustrated in FIG. 1.
Figure 3A:
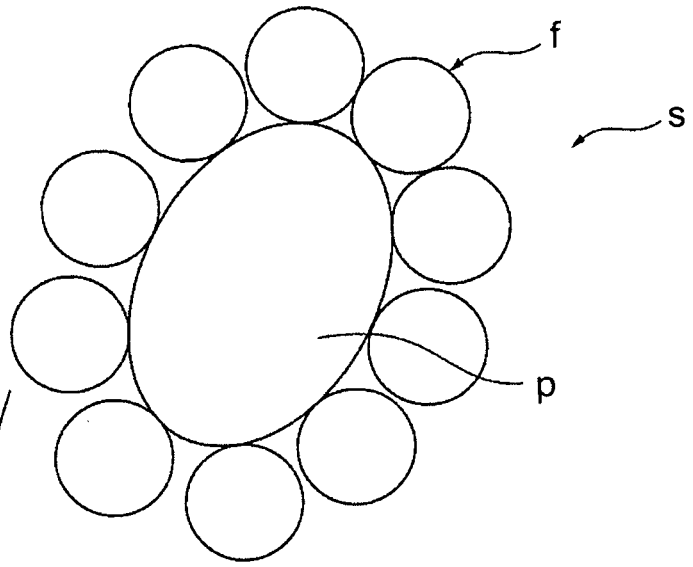
FIG. 3A is a schematic view of the foamed sand produced by the production apparatus illustrated in FIG. 1.
Figure 3B:
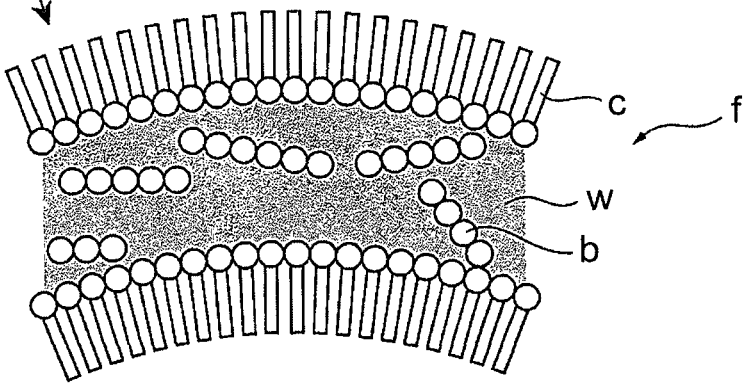
FIG. 3B is an enlarged view of foam of the foamed sand in FIG. 3A.

Hereinafter, an embodiment of the invention will be described in detail with reference to the accompanying drawings. First, a production apparatus 1 for producing foamed sand will be described below. FIG. 1 is a schematic perspective view of the production apparatus 1 for producing foamed sand according to the embodiment of the invention. FIG. 2 is a sectional view of a froth supply portion 20 of the production apparatus 1 for producing foamed sand illustrated in FIG. 1. FIG. 3A is a schematic view of foamed sand s produced by the production apparatus 1 illustrated in FIG. 1. FIG. 3B is an enlarged view of foam f of the foamed sand s in FIG. 3A.

The production apparatus 1 for producing foamed sand according to the present embodiment is an apparatus for producing foamed sand for forming a sand mold that can be used as a core (sand mold) for casting. Specifically, in the present embodiment, sand, water glass (liquid glass), water, and a surfactant are kneaded by the production apparatus 1 to produce the foamed sand s in which the foam f containing water glass b, water w, and a surfactant c adheres to the surfaces of sand particles p, as illustrated in FIG. 3A and FIG. 3B.

As illustrated in FIG. 1, the production apparatus 1 includes a storage tank 11 (an example of a storage portion), a water supply pipe 15 (an example of a water supply portion), a water glass supply pipe 16 (an example of a water glass supply portion), a froth supply portion 20, and a kneader 12 (an example of a kneader). The storage tank 11 is a container in which sand constituted by sand particles is stored. The storage tank 11 functions also as a kneading pot in which sand, water glass, and so forth are kneaded.

The kneader 12 includes a blade 12*a* and a shaft 12*b*. The blade 12*a* has a mesh structure, and kneads sand, water glass, and so forth. The shaft 12*b* supports the blade 12*a*. The blade 12*a* is disposed in the storage tank 11. When a motor (not illustrated) connected to the shaft 12*b* is driven, the blade 12*a* is rotated together with the shaft 12*b* at a prescribed rotational speed. The water supply pipe 15, the water glass supply pipe 16, and the froth supply portion 20 are disposed above the storage tank 11.

Specifically, the water supply pipe 15 is a pipe that supplies the water w into the storage tank 11. One end of the water supply pipe 15 is connected to a water supply source (not illustrated), and the other end thereof is disposed such that the water w is supplied (charged) into the storage tank 11. Similarly, the water glass supply pipe 16 is a pipe that supplies the water glass b into the storage tank 11. One end of the water glass supply pipe 16 is connected to a glass supply source (not illustrated), and the other end thereof is disposed such that the water glass b is supplied (charged) into the storage tank 11.

The froth supply portion 20 is a device that froths (foams) an aqueous surfactant solution e, in which the surfactant c is dissolved in the water w, to generate froth d, and supplies the generated froth d into the storage tank 11. The froth supply portion 20 includes a liquid supply pipe 22, an air supply pipe 23, a joining portion 21, and a porous body 26. In this specification, "froth d" means foam that contains the surfactant c and that does not contain the water glass b, and "foam f" means foam that contains the water glass b, the water w, and the surfactant c.

More specifically, as illustrated in FIG. 2, the liquid supply pipe 22 is a pipe that supplies the aqueous surfactant solution e in a liquid state before frothing. One end of the liquid supply pipe 22 is connected to a supply source (not illustrated) of the aqueous surfactant solution e, and the other end thereof is connected to an upper portion of the joining portion 21. The air supply pipe 23 is a pipe that supplies air a. One end of the air supply pipe 23 is connected to an air supply source (not illustrated), such as a compressor, and the other end thereof is connected to a side portion of the joining portion 21.

The joining portion 21 is a portion in which the aqueous surfactant solution e supplied from the liquid supply pipe 22 and the air a supplied from the air supply pipe 23 join together. A discharging portion 24 that discharges the aqueous surfactant solution e and the air a is provided at a lower portion of the joining portion 21. The porous body 26 is attached to a distal end of the discharging portion 24.

The porous body 26 is made of a material having porosity, such as sintered metal, and has a plurality of pores that allow the aqueous surfactant solution e and the air a, which have joined together at the joining portion 21, to pass therethrough. The pores provide communication between the discharging portion 24 and the outside of the froth supply portion 20. The pores have such sizes and shapes that the froth d is generated as the aqueous surfactant solution e and the air a pass through the pores. For example, a porous material (sintered metal) having a filtration accuracy of about 120 μm may be used as the porous body 26.

In the present embodiment, the production apparatus 1 is configured to select one of frothing air (air a) for frothing the aqueous surfactant solution e and discharging air for discharging the froth d remaining in the froth supply portion 20 after generation of the froth d is completed, and to cause the selected air to flow through the air supply pipe 23.

The pressure of the discharging air (0.2 to 0.35 MPa) is higher than the pressure of the frothing air (0.05 to 0.15 MPa (optimally set pressure of 0.1 MPa)). In the production apparatus 1, the air to be supplied can be switched between the frothing air and the discharging air, or the pressure of the air to be supplied can be changed to the pressure of the discharging air or the pressure of the frothing air, at a position upstream of the air supply pipe 23.

Next, a method performed by the production apparatus 1 for producing foamed sand illustrated in FIG. 1 and FIG. 2 will be described. First, a desired amount of sand is supplied into the storage tank 11. Before kneading is performed in the kneader 12, the aqueous surfactant solution e is frothed in the froth supply portion 20 to generate the froth d from the aqueous surfactant solution e, and the froth d is supplied into the storage tank 11. At the same time, a prescribed amount of water w is supplied into the storage tank 11 from the water supply pipe 15, and a prescribed amount of water glass b is supplied from the water glass supply pipe 16.

The water glass ($Na_2O.nSiO_2.mH_2O$) to be supplied into the storage tank 11 is a mixture containing silicon dioxide ($SiO_2$), sodium oxide ($Na_2O$), and water ($H_2O$). The ratio (mole ratio) among them is not limited to any particular ratio, as long as the foam f (see FIG. 3A), which will be described later, can be formed and sufficient forming property of the foamed sand can be ensured.

For example, an anion surfactant may be used as the surfactant c to be supplied into the storage tank 11. For example, a sulfate-based anion surfactant may be used as the surfactant c. The surfactant c is not limited to any particular surfactant, as long as the aqueous surfactant solution e can be frothed and the foam f (see FIG. 3B) can be formed by the surfactant c.

The aqueous surfactant solution e may contain, for example, 1 to 12 mass % of the surfactant c. When the aqueous surfactant solution e contains the surfactant c within this range, it is possible to froth the aqueous surfactant solution e to appropriately generate the froth d.

Generation of the froth d by the froth supply portion 20 will be described with reference to FIG. 2. First, the aqueous surfactant solution e is supplied from the liquid supply pipe 22, and at the same time, the air a is supplied from the air supply pipe 23. The aqueous surfactant solution e supplied from the liquid supply pipe 22 and the air a supplied from the air supply pipe 23 join together at the joining portion 21.

The aqueous surfactant solution e that has joined the air a is conveyed, by the air a, to the porous body 26 via the discharging portion 24. The porous body 26 has a plurality of pores. As the aqueous surfactant solution e passes through the pores together with the air a, the aqueous surfactant solution e can be frothed. In this way, the froth d formed of the aqueous surfactant solution e is generated.

As a result, the froth d can be generated finely and uniformly from the aqueous surfactant solution e in the froth supply portion 20 within a shorter time, for example, than when the aqueous surfactant solution e is frothed through, for example, agitation. After the froth d is supplied into the storage tank 11, the air flowing through the air supply pipe 23 is switched from the frothing air (the air a) to the discharging air, and the discharging air is caused to flow for 5 to 30 seconds such that the froth d remaining in, for example, the porous body 26 is discharged.

Next, after the froth d generated by frothing the aqueous surfactant solution e, the water glass b, and the water w are completely supplied into the storage tank 11, the froth d, the water glass b, and the water w are kneaded, by the kneader 12, together with the sand stored in the storage tank 11. Specifically, the motor (not illustrated) connected to the shaft 12*b* is driven, so that the blade 12*a* is rotated together with the shaft 12*b* at a prescribed rotational speed. In this way, as illustrated in FIG. 3A and FIG. 3B, the foamed sand s in which the foam f containing the water glass b, the water w, and the surfactant c adheres to the surfaces of the sand particles p can be obtained.

Specifically, the foam f in which the surface of an aqueous solution of the water glass b is covered with the surfactant c is formed on the sand particles p contained in the foamed sand s.

For example, when the weight ratio of the water glass, in which the mole ratio (mixing ratio) of silicon dioxide to sodium oxide is about 0.5 to 3.0, with respect to the sand is about 0.4 to 3.0%, the weight ratio of the water with respect to the sand is about 1.5 to 5.0%, and the weight ratio of the surfactant with respect to the sand is about 0.003 to 2.0%, the foamed sand s having appropriate viscosity can be obtained.

As described above, according to the present embodiment, the aqueous surfactant solution e is frothed to generate the froth d from the aqueous surfactant solution e. The generated froth d, the water glass b, and the water w are kneaded together with the sand. When they are kneaded uniformly, the foam f in a desired state adheres (is adsorbed) to the surfaces of the sand particles p. Thus, it is possible to shorten the time (foaming time) of foaming by the surfactant c through further kneading.

Hereinafter, first to fourth modified examples of the production apparatus 1 illustrated in FIG. 1 will be described. In each of the modified examples described below, a controller 30A, 30B, 30C, or 30D is provided, and froth is generated under control of the controller 30A, 30B, 30C, or 30D. Note that, only differences from the production apparatus 1 illustrated in FIG. 1 will be described below in detail with reference to FIGS. 4A, 4B, FIGS. 5A, 5B, FIGS. 6A, 6B, and FIGS. 7A, 7B.

Figure 4A:
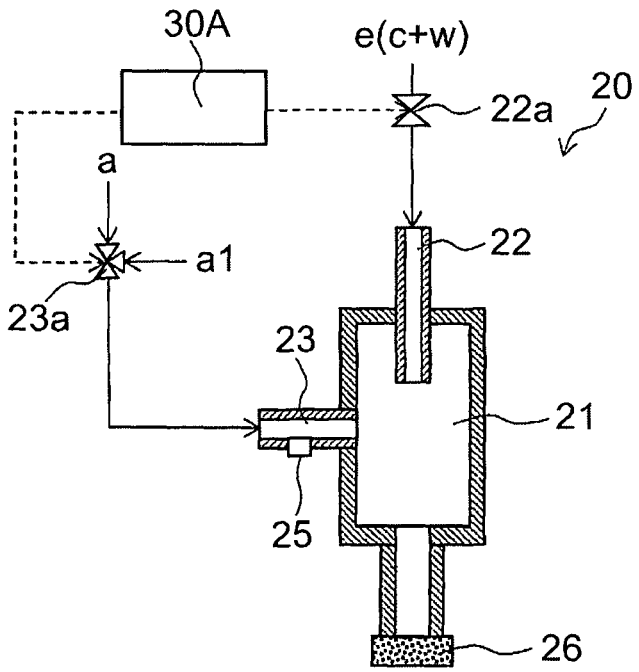
FIG. 4A is a schematic view of main portions including a controller of the production apparatus illustrated in FIG. 1 according to a first modified example.

First, the first modified example will be described. As illustrated in FIG. 4A, in the first modified example, the controller 30A controls the start and stop of the supply of the aqueous surfactant solution e from the liquid supply pipe 22, and controls the start and stop of the supply of frothing air a and discharging air a1 from the air supply pipe 23.

Specifically, in the first modified example, the liquid supply pipe 22 is connected to a supply source of the aqueous surfactant solution e via an electromagnetic valve 22*a*. The controller 30A is connected to the electromagnetic valve 22*a*. The controller 30A can control the electromagnetic valve 22*a* by inputting a control signal into the electromagnetic valve 22*a*, thereby selecting supply of the aqueous surfactant solution e or stop of the supply of the aqueous surfactant solution e (no supply of the aqueous surfactant solution e).

The air supply pipe 23 is connected, via an electromagnetic valve (three-way valve) 23*a*, to a supply source of the frothing air a and a supply source of the discharging air a1 having a higher pressure than that of the frothing air a. The controller 30A is connected to the electromagnetic valve 23*a*. The controller 30A can control the electromagnetic valve 23*a* by inputting a control signal into electromagnetic valve 23*a*, thereby selecting supply of the frothing air a, supply of the discharging air a1, or stop of the supply of the frothing air a and the discharging air a1 (no supply of the frothing air a and the discharging air a1).

Figure 4B:
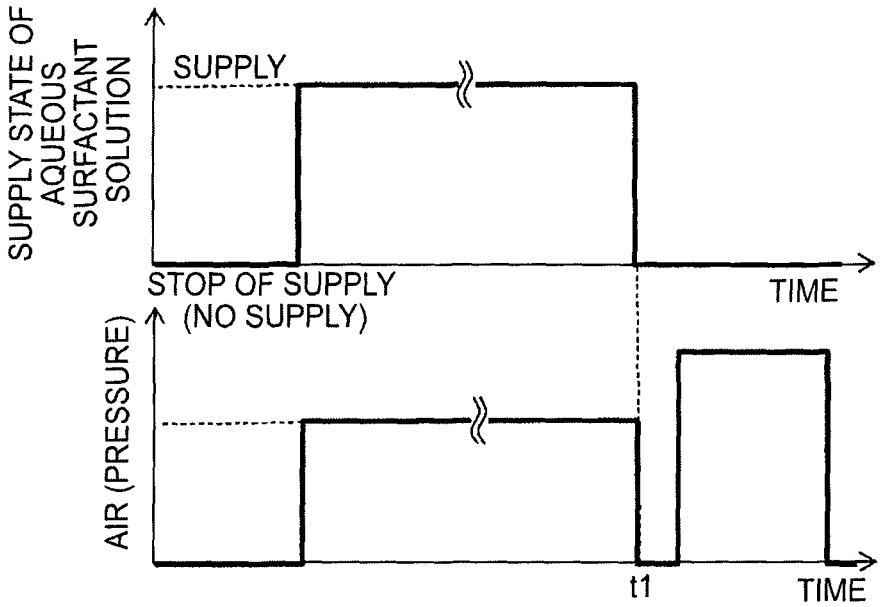
FIG. 4B is a time-series chart illustrating control executed by the controller in the first modified example.

In the first modified example, as illustrated in FIG. 4B, at the start of production of the foamed sand, the controller 30A controls the electromagnetic valves 22*a*, 23*a* to start the supply of the aqueous surfactant solution e from the liquid supply pipe 22 and to start the supply of the frothing air a from the air supply pipe 23 at the same time as the start of the supply of the aqueous surfactant solution e.

Then, a prescribed amount of froth is supplied into the storage tank 11. Subsequently, the controller 30A controls the electromagnetic valves 22*a*, 23*a* to stop the supply of the aqueous surfactant solution e from the liquid supply pipe 22 and to temporarily stop the supply of the frothing air a from the air supply pipe 23 at the same time as the stop of the supply of the aqueous surfactant solution e (see time t1 in FIG. 4B).

After that, the controller 30A controls the electromagnetic valve 23*a* to restart the supply of the air from the air supply pipe 23 such that the discharging air a1 having a higher pressure than that of the frothing air a supplied before the temporary stop of the supply is supplied for a prescribed time.

Thus, after the supply of the froth into the storage tank 11 is completed, the aqueous surfactant solution e remaining in the froth supply portion 20 can be discharged therefrom, so that dripping of the aqueous surfactant solution e from the porous body 26 can be prevented or reduced. In the first modified example, the controller 30A controls the electromagnetic valves 22*a*, 23*a*. Alternatively, the controller 30A may directly control, for example, a compressor serving as a supply source of the frothing air a and the discharging air a1, and a pump serving as a supply source of the aqueous surfactant solution e.

Figure 5A:
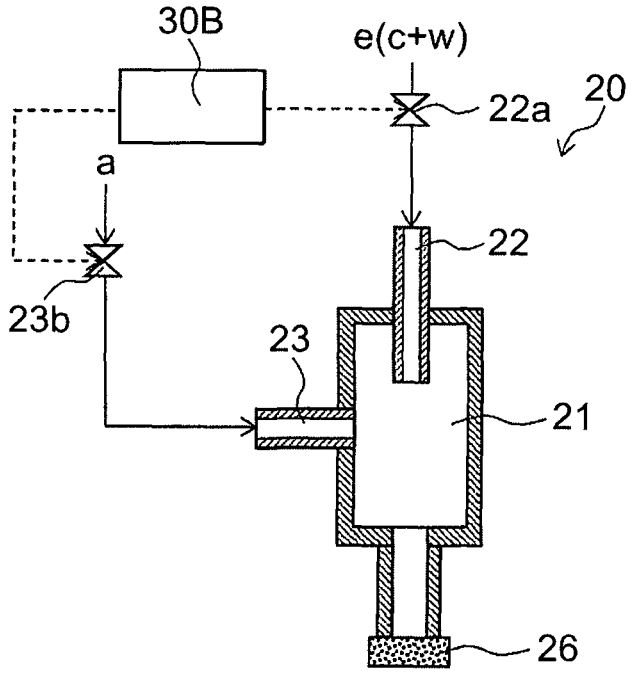
FIG. 5A is a schematic view of main portions including a controller of the production apparatus illustrated in FIG. 1 according to a second modified example.

Next, a second modified example will be described. As illustrated in FIG. 5A, the second modified example differs from the first modified example in that the aqueous surfactant solution e remaining in the froth supply portion 20 is discharged by the (frothing) air a without using the discharging air a1 having a high pressure. Note that, the same configurations as those in the first modified example will be denoted by the same reference numerals as those in the first modified example, and detailed description thereof will be omitted.

In the second modified example, the air supply pipe 23 is connected to a supply source of the (frothing) air a via an electromagnetic valve 23*b*. The controller 30B is connected to the electromagnetic valve 23*b*. The controller 30B can control the electromagnetic valve 23*b* by transmitting a control signal to the electromagnetic valve 23*b*, thereby selecting supply of the air a or stop of the supply of the air a (no supply of the air a).

Figure 5B:
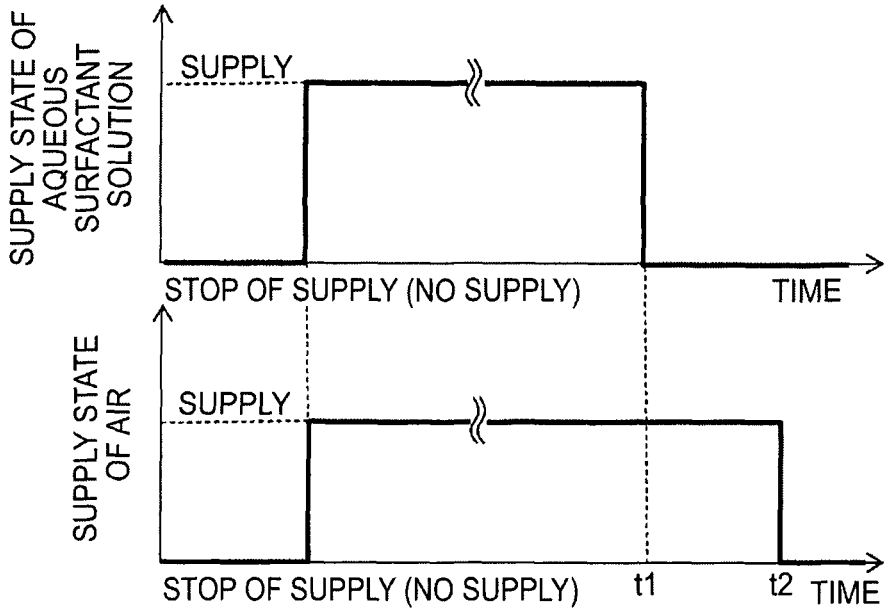
FIG. 5B is a time-series chart illustrating control executed by the controller in the second modified example.

In the second modified example, as illustrated in FIG. 5B, at the start of production of the foamed sand, the controller 30B controls the electromagnetic valves 22*a*, 23*b* to start the supply of the aqueous surfactant solution e from the liquid supply pipe 22 and to start the supply of the air a from the air supply pipe 23 at the same time as the start of the supply of the aqueous surfactant solution e.

Then, a prescribed amount of froth is supplied into the storage tank 11. Subsequently, the controller 30B controls the electromagnetic valves 22*a* to stop the supply of the aqueous surfactant solution e from the liquid supply pipe 22 (see time t1 in FIG. 5B). In the second modified example, the supply of the air a is continued for a prescribed time from the stop of the supply of the aqueous surfactant solution e. Then (i.e., after a lapse of the prescribed time), the electromagnetic valve 23*b* is controlled to stop the supply of the air a from the air supply pipe 23 (see time t2 in FIG. 5B).

Thus, after the supply of the froth into the storage tank 11 is completed, the aqueous surfactant solution e remaining in the froth supply portion 20 can be discharged therefrom by the air a, so that dripping of the aqueous surfactant solution e from the porous body 26 can be prevented or reduced. In the second modified example, the controller 30B controls the electromagnetic valves 22*a*, 23*b*. Alternatively, the controller 30B may directly control, for example, a compressor serving as a supply source of the air a, and a pump serving as a supply source of the aqueous surfactant solution e.

Figure 6A:
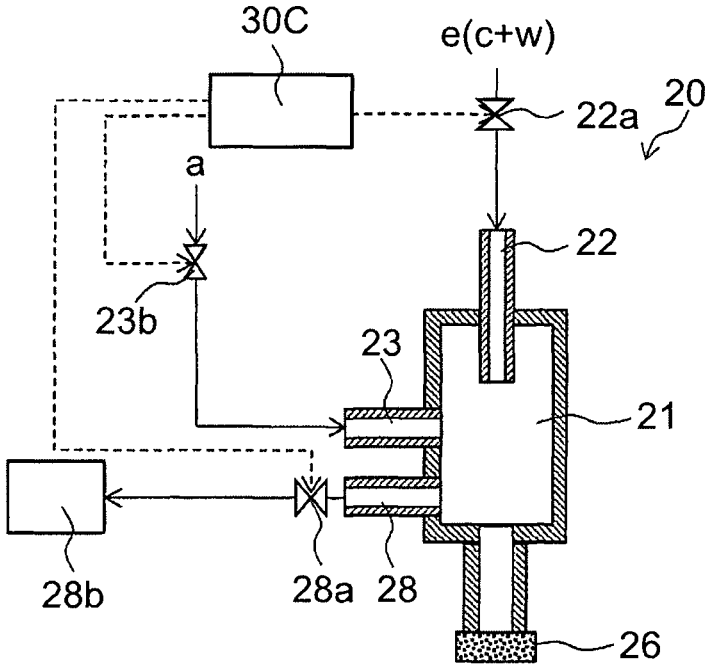
FIG. 6A is a schematic view of main portions including a controller of the production apparatus illustrated in FIG. 1 according to a third modified example.

Next, a third modified example will be described. As illustrated in FIG. 6A, the third modified example differs from the second modified example in that the aqueous surfactant solution e remaining in the froth supply portion 20 is suctioned by a vacuum mechanism instead of discharging the aqueous surfactant solution e remaining in the froth supply portion 20 using the air a. Note that, the same configurations as those in the second modified example will be denoted by the same reference numerals as those in the second modified example, and detailed description thereof will be omitted.

As illustrated in FIG. 6A, the froth supply portion 20 includes a discharge pipe 28 connected to the joining portion 21, and the discharge pipe 28 is connected to a vacuum pump (suction pump) 28*b* via an electromagnetic valve 28*a*. Thus, when the vacuum pump 28*b* is driven, a negative pressure is generated in the inside of the joining portion 21. The discharge pipe 28, the electromagnetic valve 28*a*, and the vacuum pump 28*b* may function as the vacuum mechanism. A cylinder mechanism or the like may be used instead of the vacuum pump 28*b*, as long as a negative pressure can be generated in the inside of the joining portion 21.

In the third modified example as in the second modified example, the controller 30C controls the electromagnetic valves 22*a*, 23*b*. Further, the controller 30C controls opening and closing of the electromagnetic valve 28*a*, thereby selecting operation of the vacuum mechanism or stop of the operation of the vacuum mechanism.

Figure 6B:
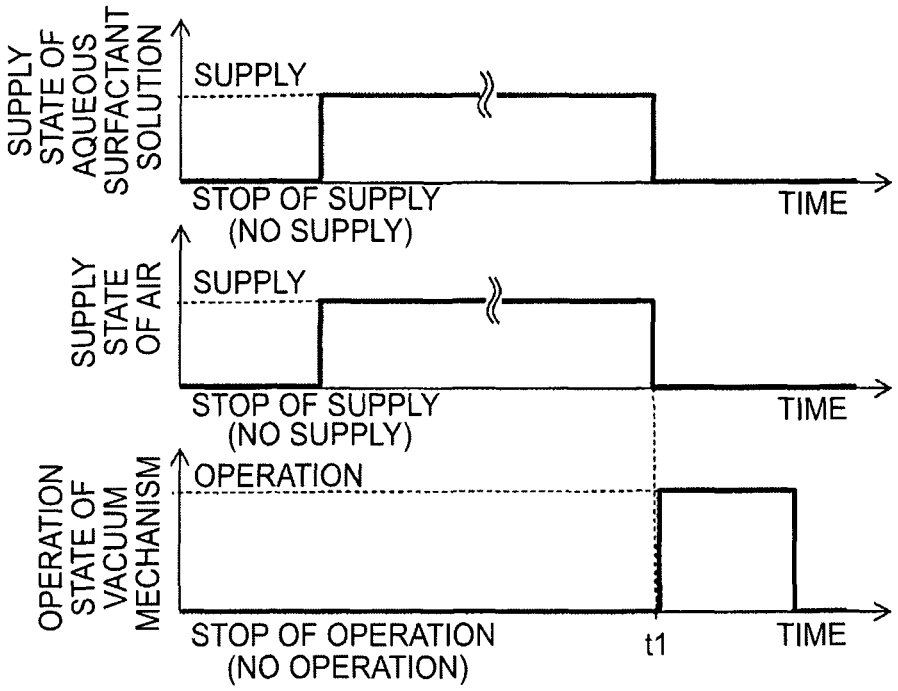
FIG. 6B is a time-series chart illustrating control executed by the controller in the third modified example.

In the third modified example, as illustrated in FIG. 6B, at the start of production of the foamed sand, the controller 30C controls the electromagnetic valves 22*a*, 23*b* to start the supply of the aqueous surfactant solution e from the liquid supply pipe 22 and to start the supply of the air a from the air supply pipe 23 at the same time as the start of the supply of the aqueous surfactant solution e.

Then, a prescribed amount of froth is supplied into the storage tank 11. Subsequently, the controller 30C controls the electromagnetic valves 22*a*, 23*b* to stop the supply of the aqueous surfactant solution e from the liquid supply pipe 22 and to stop the supply of the air a from the air supply pipe 23 at the same time as the stop of the supply of the aqueous surfactant solution e (see time t1 in FIG. 6B).

After that, the controller 30C controls the electromagnetic valve 28*a* such that the electromagnetic valve 28*a* is kept open for a prescribed time (operates the vacuum mechanism for the prescribed time), so that the aqueous surfactant solution e remaining in the froth supply portion 20 is suctioned by the vacuum pump 28*b*. In this way, dripping of the aqueous surfactant solution e from the porous body 26 can be prevented or reduced. Further, in the third modified example, the electromagnetic valve 28*a* is controlled. Alternatively, the operation of the vacuum pump 28*b* and stop of the operation of the vacuum pump 28*b* may be directly controlled without providing the electromagnetic valve 28*a*.

Figure 7A:
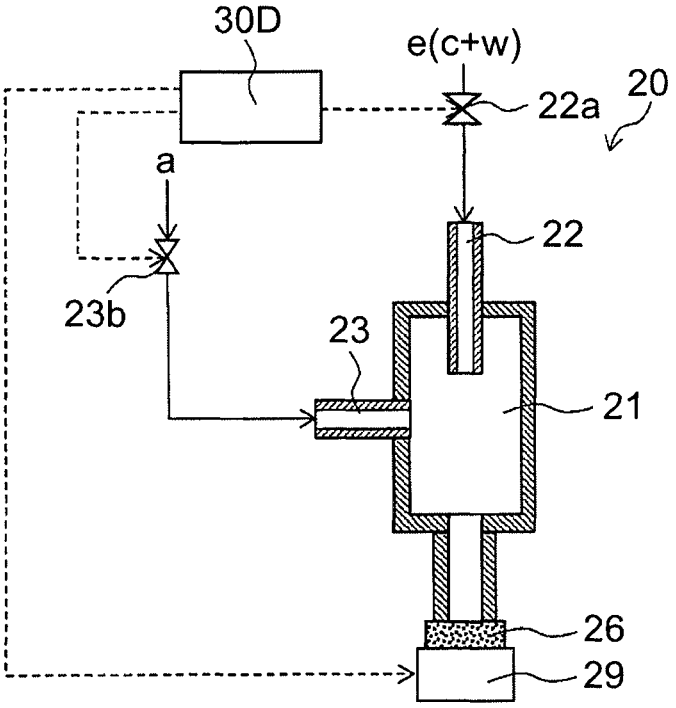
FIG. 7A is a schematic view of main portions including a controller of the production apparatus illustrated in FIG. 1 according to a fourth modified example.

Next, a fourth modified example will be described. As illustrated in FIG. 7A, the fourth modified example differs from the second modified example in that discharge of the remaining froth is reduced by an on-off valve 29 instead of discharging the froth remaining in the froth supply portion 20 using the air a. Note that, the same configurations as those in the second modified example will be denoted by the same reference numerals as those in the second modified example, and detailed description thereof will be omitted.

As illustrated in FIG. 7A, the on-off valve 29 is disposed below the porous body 26 of the froth supply portion 20. The on-off valve 29 is connected to the froth supply portion 20 such that the froth is supplied into the storage tank 11 from the porous body 26 while the on-off valve 29 is open and the supply of the froth from the porous body 26 into the storage tank 11 is stopped while the on-off valve 29 is closed. The controller 30D is connected to the on-off valve 29. The controller 30D can select opening or closing of the on-off valve 29 by transmitting a control signal to the on-off valve 29.

Figure 7B:
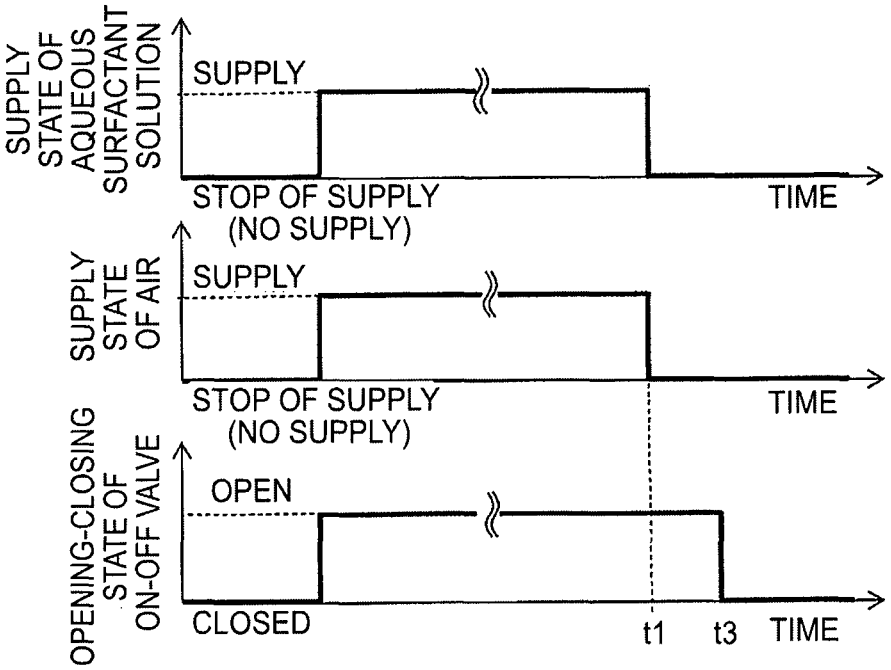
FIG. 7B is a time-series chart illustrating control executed by the controller in the fourth modified example.

In the fourth modified example, as illustrated in FIG. 7B, the controller 30D controls the electromagnetic valves 22*a*, 23*b* and the on-off valve 29, at the start of production of the foamed sand. Specifically, the controller 30D starts the supply of the aqueous surfactant solution e from the liquid supply pipe 22, and starts the supply of the air a from the air supply pipe 23 and opens the on-off valve 29 at the same time as the start of the supply of the aqueous surfactant solution e.

Then, a prescribed amount of froth is supplied into the storage tank 11. Subsequently, the controller 30D controls the electromagnetic valves 22*a*, 23*b* to stop the supply of the aqueous surfactant solution e from the liquid supply pipe 22 and to stop the supply of the air a from the air supply pipe 23 at the same time as the stop of the supply of the aqueous surfactant solution e (see time t1 in FIG. 7B). After that, the controller 30D closes the on-off valve 29 after a lapse of a prescribed time from the stop of the supply of the aqueous surfactant solution e and the air a (see time t3 in FIG. 7B).

As described above, the on-off valve 29 is closed after the lapse of the prescribed time. Thus, the aqueous surfactant solution e in the froth supply portion 20 is exhausted, and then dripping of the aqueous surfactant solution e from the porous body 26 can be prevented or reduced.

Hereinafter, an example of the invention will be described.

Example

Foamed sand was produced by the production apparatus illustrated in FIG. 1. First, sand, water glass, a surfactant, and water were provided such that the weight of the sand to be supplied into the storage tank was 5000 g, the weight of the water glass to be supplied into the storage tank was 0.65% of the weight of the sand, the weight of the surfactant to be supplied into the storage tank was 0.03% of the weight of the sand, and the weight of the water to be supplied into the storage tank was 3.2% of the weight of the sand.

The sand was supplied into the storage tank. Then, the aqueous surfactant solution containing the surfactant of 3 mass % was provided. The pressure of the air joining the aqueous surfactant solution was set to 0.1 Mpa. The aqueous surfactant solution was frothed in the froth supply portion to generate froth, and the froth was supplied into the storage tank such that the amount of surfactant was the above-described amount. At the same time, the water glass and the water were supplied into the storage tank such that the amount of water glass and the amount of water were the above-described amounts. Then, the sand, the froth, the water glass, and the water were kneaded to produce foamed sand.

Figure 8:
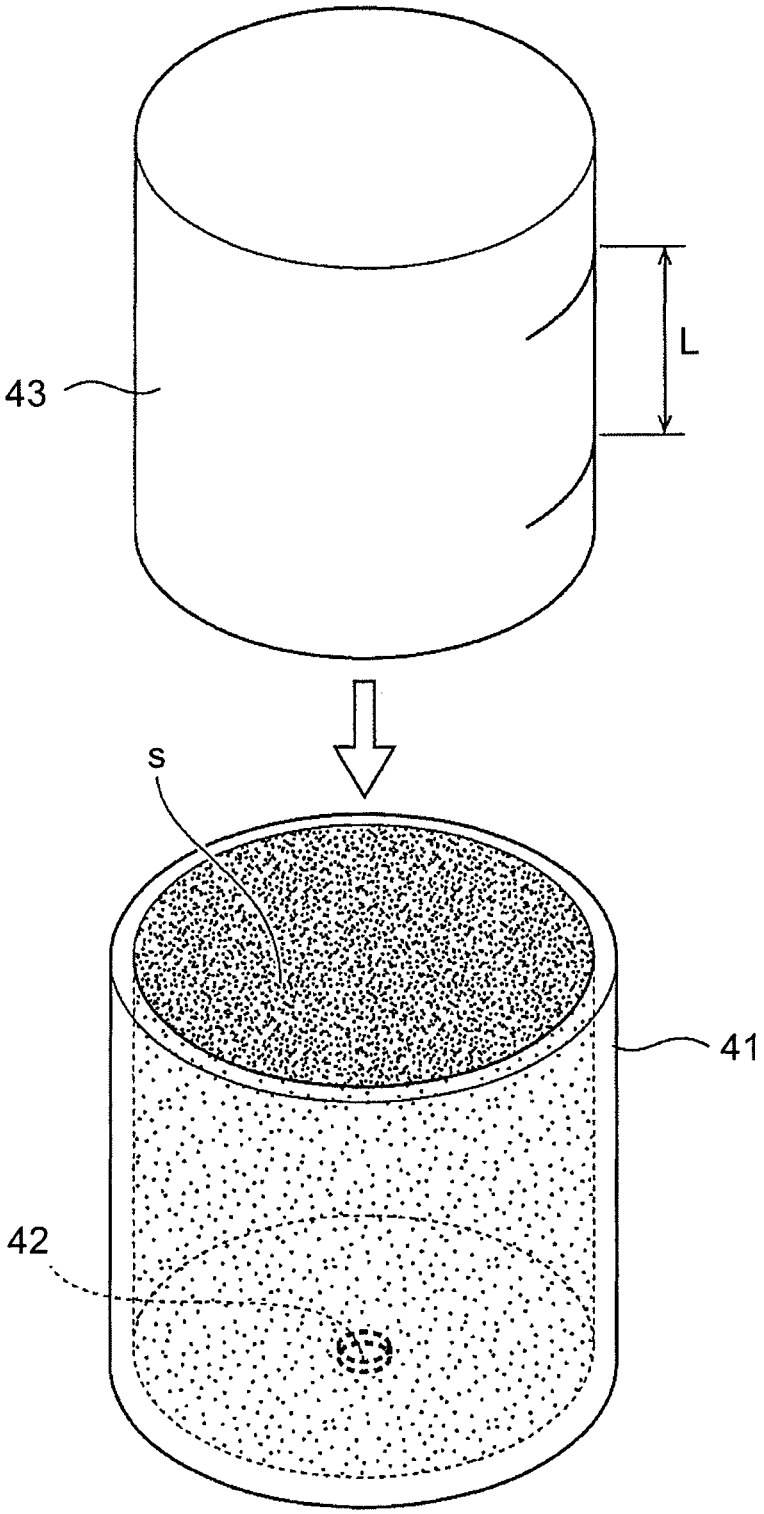
FIG. 8 is a schematic perspective view of a device for measuring a kinematic viscosity of foamed sand.
Figure 9:
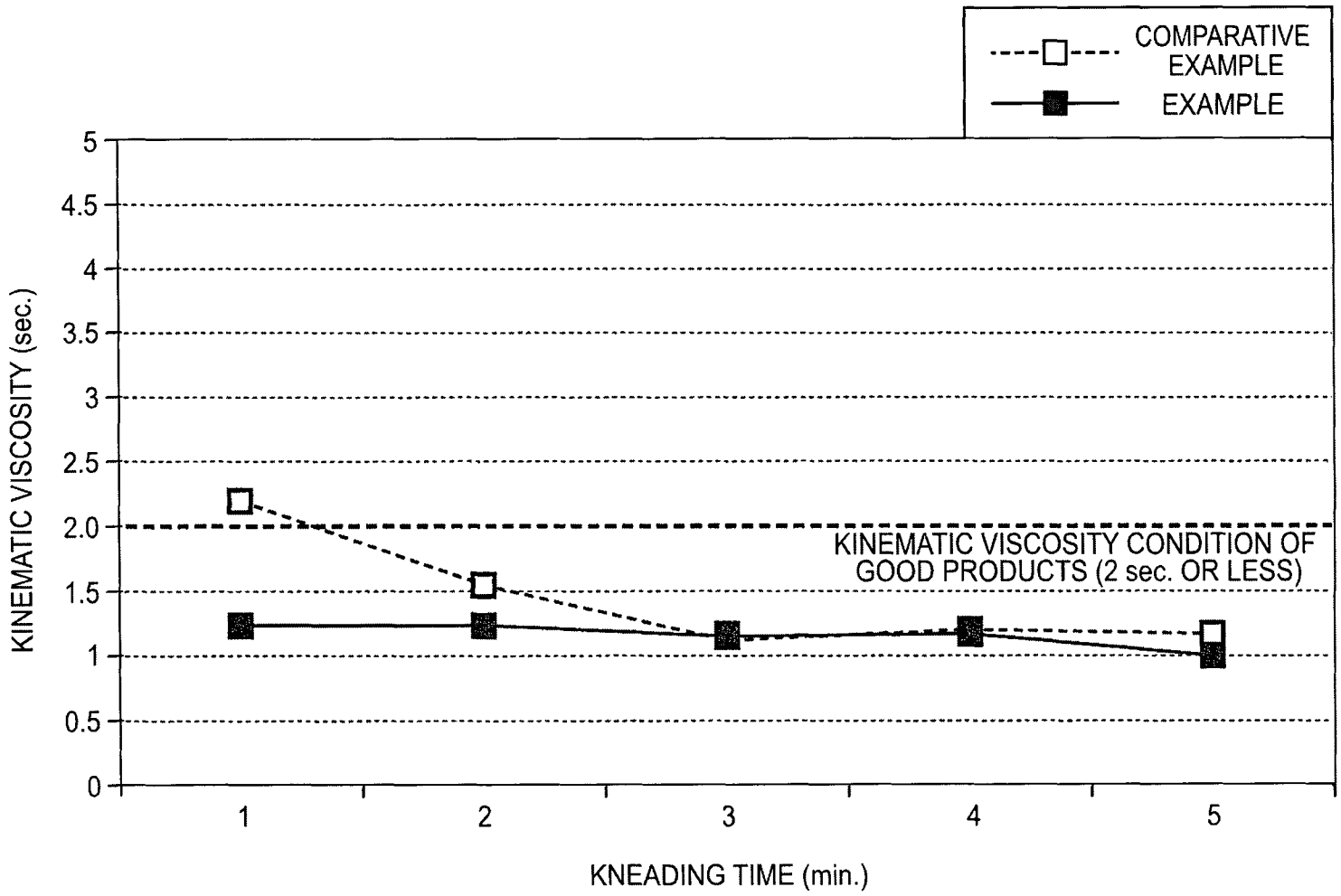
FIG. 9 is a graph illustrating the results of measurement of the kinematic viscosity of foamed sand produced by the method described in an example of the invention and foamed sand produced by a method described in a comparative example.

The kneading time from the start of kneading was 1 to 5 minutes. The foamed sand was collected at intervals of 1 minute, and the kinematic viscosity of the foamed sand was measured by a device including a container 41 and a weight 43 illustrated in FIG. 8. Specifically, as illustrated in FIG. 8, the foamed sand was charged into the container 41 up to its upper portion, and the weight 43 having a measurement portion (measurement section) L was placed on the foamed sand. As a result, the foamed sand s was pressed by the weight of the weight 43, the foamed sand was discharged from a hole 42 in a bottom portion of the container 41, and the weight 43 was moved downward. In this case, the time (passage time) required for the measurement portion L indicated on the weight 43 to pass through an opening edge of the container 41 (passage time) was measured as the kinematic viscosity. FIG. 9 indicates the results.

When the kinematic viscosity of the sand is low, the foamed sand is discharged from the hole 42 of the container 41 at a high speed and the passage time required for the measurement portion L to pass through the opening edge of the container 41 is short. As a result, the foamed sand can be determined as a good product. In the example, when the kinematic viscosity (the passage time) is two seconds or less, it is determined that the foam uniformly adheres to the surfaces of the sand particles and the foamed sand is a good product.

Comparative Example

A comparative example will be described below. Foamed sand was produced in the same manner as that in the example. The comparative example differs from the example in that the aqueous surfactant solution was directly supplied into the storage tank without being frothed. As in the example, the kneading time was 1 to 5 minutes, the foamed sand was collected at intervals of 1 minute, and the kinematic viscosity of the foamed sand was measured by the device including the container 41 and the weight 43 illustrated in FIG. 8.

RESULTS AND CONSIDERATIONS

As illustrated in FIG. 9, in the example, regardless of the kneading time, the kinematic viscosity was 2 seconds or less. On the other hand, in the comparative example, at the kneading time of 1 minute, the kinematic viscosity exceeded 2 seconds, and as the kneading time increased, the kinematic viscosity approached the kinematic viscosity in the example.

In the example, it is considered that the foam was sufficiently formed on the surfaces of the sand particles within a short time after the start of the kneading because the froth generated by frothing the aqueous surfactant solution was supplied at the start of the kneading.

On the other hand, in the comparative example, it is considered that the foam was formed on the surfaces of the sand particles as the kneading advanced from the start of the kneading, and it is considered that the foam was not sufficiently formed at the kneading time of 1 minute. Based on the results, it is considered that the production time (kneading time) for producing the foamed sand can be reduced by generating the froth from the aqueous surfactant solution before the kneading, as in the example.

While the embodiment of the invention has been described in detail above, the specific configurations are not limited to those in the embodiment, and design changes within the scope of the invention may also be included in the invention. In addition, the embodiment and the modified examples may be implemented in various combinations as appropriate.

In the embodiment, a flow path in the joining portion, through which the aqueous surfactant solution and the air flow, is a T-shaped flow path. Alternatively, the flow path may be, for example, a Y-shaped flow path.

In addition, a pressure sensor 25 that measures a pressure of the air in an air flow path of the air supply pipe in the embodiment may be provided. With this configuration, an insufficient supply of the air from the air supply pipe can be found, and the occurrence of insufficient generation of the froth can be reduced in advance.

What is claimed is:

1. A method of producing foamed sand for forming a sand mold, the foamed sand including sand particles and foam adhering to surfaces of the sand particles, the foam containing water glass, water, and a surfactant, the method comprising:

generating froth from an aqueous surfactant solution in which the surfactant is dissolved, by frothing the aqueous surfactant solution; and kneading the generated froth, the water glass, and the water together with the sand constituted by the sand particles.

2. The method according to claim 1, wherein, when the froth is generated, the aqueous surfactant solution is frothed by causing the aqueous surfactant solution to pass through a plurality of pores together with air.

3. A production apparatus for producing foamed sand for forming a sand mold, the foamed sand including sand particles and foam adhering to surfaces of the sand particles, the foam containing water glass, water, and a surfactant, the production apparatus comprising:

a storage portion in which sand constituted by the sand particles is stored;

a water glass supply portion configured to supply the water glass into the storage portion;

a water supply portion configured to supply the water into the storage portion;

a froth supply portion configured to supply, into the storage portion, froth generated by frothing an aqueous surfactant solution in which the surfactant is dissolved; and a kneader configured to knead, in the storage portion, the sand with the water glass, the water, and the froth supplied into the storage portion.

4. The production apparatus according to claim 3, wherein the froth supply portion includes:

a liquid supply pipe configured to supply the aqueous surfactant solution;

an air supply pipe configured to supply air;

a joining portion in which the aqueous surfactant solution supplied from the liquid supply pipe and the air supplied from the air supply pipe join together; and a porous body having a plurality of pores, the porous body configured to allow the aqueous surfactant solution and the air that have joined in the joining portion to pass through the porous body to froth the aqueous surfactant solution.

5. The production apparatus according to claim 4, further comprising a controller configured to control start and stop of supply of the aqueous surfactant solution from the liquid supply pipe, and control start and stop of supply of the air from the air supply pipe, wherein the controller is configured to:

i) start the supply of the air from the air supply pipe when the supply of the aqueous surfactant solution from the liquid supply pipe is started;

ii) then temporarily stop the supply of the air from the air supply pipe when the supply of the aqueous surfactant solution from the liquid supply pipe is stopped; and iii) then restart the supply of the air from the air supply pipe such that air having a pressure higher than a pressure of the air supplied before temporary stop of the supply is supplied for a prescribed time.

6. The production apparatus according to claim 4, further comprising a controller configured to control start and stop of supply of the aqueous surfactant solution from the liquid supply pipe, and control start and stop of supply of the air from the air supply pipe, wherein the controller is configured to:

i) start the supply of the air from the air supply pipe when the supply of the aqueous surfactant solution from the liquid supply pipe is started;

ii) then stop the supply of the aqueous surfactant solution from the liquid supply pipe; and iii) stop the supply of the air from the air supply pipe after a lapse of a prescribed time from the stop of the supply of the aqueous surfactant solution.

7. The production apparatus according to claim 4, further comprising:

a vacuum mechanism connected to the joining portion, the vacuum mechanism configured to operate to generate a negative pressure in an inside of the joining portion; and a controller configured to control start and stop of supply of the aqueous surfactant solution from the liquid supply pipe, control start and stop of supply of the air from the air supply pipe, and control an operation of the vacuum mechanism and stop of the operation, wherein the controller is configured to:

i) start the supply of the air from the air supply pipe when the supply of the aqueous surfactant solution from the liquid supply pipe is started;

ii) then stop the supply of the air from the air supply pipe when the supply of the aqueous surfactant solution from the liquid supply pipe is stopped; and iii) then operate the vacuum mechanism for a prescribed time from the stop of the supply of the air and the aqueous surfactant solution.

8. The production apparatus according to claim 4, further comprising:

an on-off valve disposed below the porous body, the on-off valve configured to allow supply of the froth from the porous body into the storage portion while the on-off valve is open, and stop the supply of the froth from the porous body into the storage portion while the on-off valve is closed; and a controller configured to control start and stop of supply of the aqueous surfactant solution from the liquid supply pipe, control start and stop of supply of the air from the air supply pipe, and control opening and closing of the on-off valve, wherein the controller is configured to:

i) open the on-off valve and start the supply of the air from the air supply pipe when the supply of the aqueous surfactant solution from the liquid supply pipe is started;

ii) then stop the supply of the air from the air supply pipe when the supply of the aqueous surfactant solution from the liquid supply pipe is stopped; and iii) then close the on-off valve after a lapse of a prescribed time from the stop of the supply of the air and the aqueous surfactant solution.

9. The production apparatus according to claim 4, further comprising a pressure sensor configured to measure a pressure of the air in an air flow path of the air supply pipe.

* * * * *